US005568696A

United States Patent [19]

Mauch et al.

[11] Patent Number: 5,568,696

[45] Date of Patent: Oct. 29, 1996

[54] REDUCED CAPACITY MAGAZINE FOR REPEATER FIREARM

[75] Inventors: Ernst Mauch, Dunningen; Helmut Weldle, Oberndorf-Beffendorf; Johannes-August Bantle, Bösingen; Erwin Epp, Dornhan, all of Germany

[73] Assignee: Heckler & Koch GmbH, Obernorf/Neckar, Germany

[21] Appl. No.: 320,851

[22] Filed: Oct. 11, 1994

[30] Foreign Application Priority Data

Sep. 9, 1994 [DE] Germany ..... 44 32 192.9

[51] Int. Cl.[6] ..... F41A 9/71

[52] U.S. Cl. ..... 42/49.02; 42/50

[58] Field of Search ..... 42/49.02, 50

[56] References Cited

U.S. PATENT DOCUMENTS

| | | | |
|---|---|---|---|
| 1,833,862 | 11/1931 | Schmeisser | 42/50 |
| 2,296,729 | 9/1942 | Mossberg | 42/50 |
| 4,936,037 | 6/1990 | Holcomb et al. | 42/50 |
| 5,113,605 | 5/1992 | Kwang | 42/50 |

FOREIGN PATENT DOCUMENTS

| | | | |
|---|---|---|---|
| 1269918 | 6/1968 | Germany . | |
| 3844112 | 7/1990 | Germany . | |
| 8810404 | 12/1988 | WIPO | 42/50 |

*Primary Examiner*—Stephen C. Bentley

*Attorney, Agent, or Firm*—Cohen, Pontani, Lieberman, Pavane; Christa Hildebrand

[57] ABSTRACT

This invention relates to a magazine for a repeater firearm, preferably for an automatic pistol which, while approximately preserving its external dimensions, is modified so that the usable capacity inside the magazine is reduced. In one refinement, the invention relates to a magazine with a magazine tube (1), a magazine spring (4), a feeder (7) and a magazine base (2). To reduce the usable capacity of the magazine, a spacer (6) is attached to the magazine base (2) facing the magazine spring (4). The magazine spring (4) is also shortened so that, in the absence of the spacer (6), it does not exert sufficient force on the feeder (7) to reliably advance the last cartridges (9) to the magazine lips on the end of the magazine tube (1). In addition to or instead of the features described above, the spacer (6) can be designed so that in its absence, and if the magazine is filled with bullets, the magazine base is partly or completely detached from its mounting on the other end of the magazine tube (1).

15 Claims, 3 Drawing Sheets

REDUCED CAPACITY MAGAZINE FOR REPEATER FIREARM

BACKGROUND OF THE INVENTION

1. Field of the Invention

This invention relates to a magazine for a repeater firearm, in particular an automatic pistol.

2. Description of the Related Art

A magazine for an automatic pistol is disclosed in DE-AS 1 269 918.

The problem addressed by the invention is that repeater firearms which, in their original design, are capable of holding a defined number of bullets in their magazine designated the "original magazine" below—are sometimes used in situations where only a smaller number of cartridges is permitted, such as in sporting competitions, or where the number of cartridges is limited by laws or regulations in force in the location where the firearm is used. In those cases. a magazine with a reduced loading capacity must be used.

If and to the extent that the weapons in question have external magazines, this reduction of the loading capacity ceases to be a problem, since the original magazine can quite simply be shortened practically as much as necessary. But for weapons in which the magazine is largely or completely housed inside a component, e.g. in the handle of an automatic pistol, a magazine with a reduced loading capacity must in each case be exactly as long as the full length of the "original magazine".

With such plug-in magazines, it might be possible to use a magazine that was shorter overall, and to which an extension could be attached from the outside. But since a magazine holder is often located on the end of the handle, the total length of the magazine is a critical dimension, for which the tolerances may be extremely stringent.

Potential buyers may also prefer a magazine with a reduced loading capacity, the appearance of which is similar to the original magazine, on account of its greater authenticity—i.e. reasons of importance to collectors—and may be disinclined to purchase a shortened magazine to which an extension has been attached merely because of its appearance.

Finally, it should also be possible to use as many of the parts of the original magazine—which continue to be available from the manufacturer—as possible, to avoid unnecessarily complicating the manufacturing process.

SUMMARY OF THE INVENTION

The object of the invention is therefore to provide a magazine having a spacer for reducing the usable capacity of a magazine while preserving the external dimensions of a conventional magazine.

The invention provides a magazine having a magazine tube, a magazine spring, a feeder and a magazine base, wherein the spacer is inserted on a magazine base facing the magazine spring, and wherein the magazine spring is provided which, in the absence of the spacer, the spring does not exert force on the feeder to advance the last bullet to the end of the magazine tube, and wherein the spacer is designed to interact with the magazine base so that in the absence of the spacer, and when the magazine is loaded with more cartridges than permitted, the magazine base is at least partly detached from its mounting on the other end of the magazine tube.

In one preferred embodiment, a restoration to a conventional, full loading capacity is not possible, at least with the knowledge and equipment which are available to an average marksman. On the other hand, it remains guaranteed that the magazine can be fully disassembled.

The invention teaches that a spacer is located between the magazine spring and the magazine base, on which the shortened magazine spring is supported. If the spacer is removed, the magazine spring is then too short for the length of the magazine tube now available, so that the last cartridges can no longer be advanced, and the first of these final cartridges can also cause jamming.

Of course it is possible to stretch the magazine spring before it is inserted, but if the user wishes to use the full original loading capacity and fills the magazine all the way, the spring will again be compressed to the point where the problems indicated above can be expected.

It is very obviously out of the question to expect an amateur craftsman to make an entirely new magazine spring.

The spacer and the magazine base can preferably be designed as a single component or can be inseparably connected to each other, so that the magazine must be used with the spacer, unless structural modifications are made.

As claimed in an alternative or additional second step, however, the invention teaches that the magazine base and the spacer are designed as separate pieces which are complementary to one another, so that the magazine base cannot perform its function unless the spacer is in its specified position. In this case, either the magazine base is detached from its mounting on the magazine tube or magazine housing, or it breaks, if the force of the magazine spring is exerted not on the spacer, but directly on the magazine base. In this case, the above-mentioned detachment or destruction occurs at the latest when (in the absence of the spacer) more cartridges are loaded into the magazine than its reduced loading capacity is designed to hold.

Basically, as claimed by the invention, it is possible and advantageous to manufacture the magazine base and the spacer as one piece, whereby only the spacer, and not the magazine base, is held on the magazine tube. If these two elements are separated from one another and the spacer is missing, it is impossible to attach the magazine base to the magazine tube.

In another preferred embodiment the invention, it is advantageous to design the spacer and the magazine base as separate components, and to have the magazine spring act on the spacer so that the latter is pushed into its rest position, in which it guarantees a locking between the magazine base and the magazine tube. But if the spacer is missing, when the magazine is overfilled, either the magazine base detaches or the mounting parts of this magazine base become detached. In any case, the magazine cannot be filled beyond the reduced loading capacity.

The spring plate piece can, for example, be an embossed sheet metal plate, while the spacer can be made of plastic. However, the spring plate is designed so that it forms one piece with the spacer, which has the advantage that when the spacer is removed, there is also no suitable seating surface for the spring, which could otherwise be modified.

The spacer can be designed as a one-piece component, and is preferably made of plastic. It is of particular advantage to make the spacer as a component which consists of several pieces; for example, to make a segment—if possible—which is exposed to a particularly severe load out of steel, and which can be set into or injected into the surrounding plastic part.

As noted above, the magazine base and the spacer can advantageously be permanently connected to one another. This connection can be designed so that it allows a relative movement of the spacer with respect to the magazine base, but makes it impossible to completely separate these two elements impossible without destroying them. For example, the configurations and advantages made possible by the mobility of the spacer are all still available, but only the removal of the spacer ultimately results in the destruction of the magazine, whereby the connection between the spacer and the magazine base can be selected so that the latter, for its part, is necessarily damaged and becomes unusable in the event of the forcible removal of the spacer.

To move the spacer out of its rest position, it is possible, for example, to provide a slot in the wall of the magazine tube, into which a tool can be introduced to move the spacer. It is particularly advantageous to leave a hole in the magazine base, through which the spacer can be pushed toward the feeder by means of a tool. The particular advantage of this configuration is that the magazine spring always holds the spacer in its rest position.

Further, there is a pin-like extension on the spacer which is designed to complement the hole in the magazine base, and sits in this hole when the spacer is in the rest position.

Thus not only is the hole closed in the rest position of the spacer, i.e. during use, so that no moisture or dirt can penetrate inside the magazine, but it is also possible to use the tip of a bullet as the tool, since the necessary tool need not be long and slender. For example, it is even possible to clean the magazine while the user is out hunting, where the hunter generally does not carry tools to disassemble the weapon with him. Such a cleaning may be necessary if the magazine falls into loose sand, since coarse grains of sand which penetrate into the magazine can adversely affect the operation of the magazine.

Basically it is possible to bend the two flat sides of the magazine tube on the base-side end outward, and to push the magazine base onto the guide thereby created.

But the advantage of this configuration, namely the full utilization of the space inside the magazine tube, is not necessary for the invention. Therefore the preferred embodiment includes at least one flexible leg (or preferably two flexible legs) on the magazine base which extends toward the feeder, and which extends along the inside of opposite walls of the magazine tube, and on each of the free ends have a projection which extends into a corresponding recess in the corresponding wall of the magazine tube, forming a locking mechanism, and wherein the projections and the corresponding recesses are designed so that when the full force of the magazine spring is exerted, the projections flex toward the inside of the magazine tube, and are thereby disengaged from the recesses, and the spacer having a locking segment which, in the rest position of the spacer, supports each of the projections away from the inside of the magazine tube, but releases them when the spacer is in the disengaged position.

In this case, extending from the base of the magazine along at least two opposite sides of the magazine tube, there are two flexible legs, on whose respective ends there are projections which lock into recesses in the corresponding walls of the magazine, but do not reach all the way through this magazine wall, as shown in the prior art publication, but only sit on the edge of the projection.

It is thereby possible to bend this edge of the recess, and/or the edge of the projection in contact with it, slightly inward.

The spacer is designed so that in its rest position, the projections are supported on the inside of the magazine, so that they cannot then be moved out of the recesses.

But if the spacer is moved out of its rest position, then along with it, this support is removed from the projections, so that the projections can now move inward, whereupon they release the magazine base.

This movement inward can be initiated by the above-mentioned bevel, if a sufficiently strong force is exerted on the magazine base, such as the force which would occur in any case if the magazine, in the absence of the spacer, were to be filled beyond the reduced magazine capacity.

Such a bevel is not necessary, because the fact that the legs are made of flexible plastic makes it possible, by means of a suitable selection of the flexibility of the plastic and the cross section of the legs, to guarantee that when a load is exerted, the legs will tip the respective projections, because they are attached to the projections laterally next to the area where the force is being applied to the recess.

If a marksman removes the spacer, stretches the magazine spring and begins to load a magazine which has been modified in this manner, the base of the magazine will simply slip away from him before the magazine is full. But if the marksman inadvertently forgets to replace the spacer after disassembling and cleaning the magazine, the absence of the spacer will become apparent not later than the filling of the magazine, because the shortened magazine spring will not press against the magazine lips, as would otherwise be the case with a correctly assembled magazine.

The projections do not extent outward beyond the external contour of the magazine tube, so that they make it possible to insert the magazine into a magazine slot past the projections.

The outside of the projections can be made large enough, and can preferably be provided with a structure (e.g. ribs) which makes them easier to handle, and facilitates locating and pushing in the projections when the magazine is being disassembled.

It is also possible to provide the legs with predetermined breaking points, or even to design the legs themselves as predetermined breaking points. For example, an amateur craftsman could glue the projections into the recesses using a high-performance adhesive, and thus fill the magazine beyond the reduced loading capacity even without the spacer. If the predetermined breaking points are present, however, the legs would then break off and the magazine would be completely useless. But in no case is it possible to overload the magazine by making simple modifications.

In the configuration described above, it is necessary to form a seat on the projections, against which the locking segment of the spacer, which in its rest position supports the projections from inside, sits with a shoulder. During normal use of the magazine, therefore, the force of the magazine spring is not transmitted to the magazine base, but is transmitted by means of the projections directly into the recesses and thus into the magazine tube.

It is advantageous if, instead of or in addition to the features described above, the opening or the hole in the magazine base in which the pin-like extension of the spacer sits is enlarged, so that, as a result of the size of this hole, the magazine base can no longer support the magazine spring. The pin-like extension of the equivalent part of the spacer is thereby designed to complement the hole, so that in the rest position it closes the hole and thereby centers the spacer. The spacer also has a shoulder, by means of which it sits on the magazine base, approximately on a seat formed around the opening, or on the above-mentioned shoulder formed on the inside of the projections.

If, during the assembly of the magazine, the spacer is then left out, the opening in the magazine base remains open, and if cartridges are loaded into the magazine, the magazine spring penetrates into and through the hole, which renders the magazine unusable.

There is at least one guide projection, which is itself disclosed by the prior art, and which extends along the upper inside surface of one or preferably both of the flat sides of the magazine tube. In a conventional magazine, such a guide projection extends at right angles to the cartridges over the entire height of the magazine and forms a contact surface for the cartridges. In the configuration claimed by the invention, the guide projection extends only over the area in which the bullets are present with the reduced loading capacity, but is not present below this area.

If, after the removal of the spacer, more than the specified number of cartridges are inserted into the magazine, then the lower end of the guide projection causes a jam, or the guide projections prevent the advance of the lowest cartridges, so that jamming can be expected.

In addition to or instead of the features described above, there is a blocking projection which projects inwardly from one of the flat sides, so that the feeder can just get by it.

If the magazine is filled with the number of bullets corresponding to the reduced loading capacity, then the lowest cartridge sits practically on the blocking projection.

But if the spacer is removed and additional cartridges are loaded into the magazine, then the lowest cartridge becomes jammed between the blocking projection and the next cartridge, so that it takes a great deal of force to load any more cartridges.

But if the user is nevertheless able to load additional cartridges, the blocking projection prevents the advance of the cartridges in the magazine, which thus becomes temporarily unusable.

The object of the invention is explained in greater detail below with reference to the accompanying drawings:

DESCRIPTIONS OF THE PREFERRED EMBODIMENTS

Figure 2:
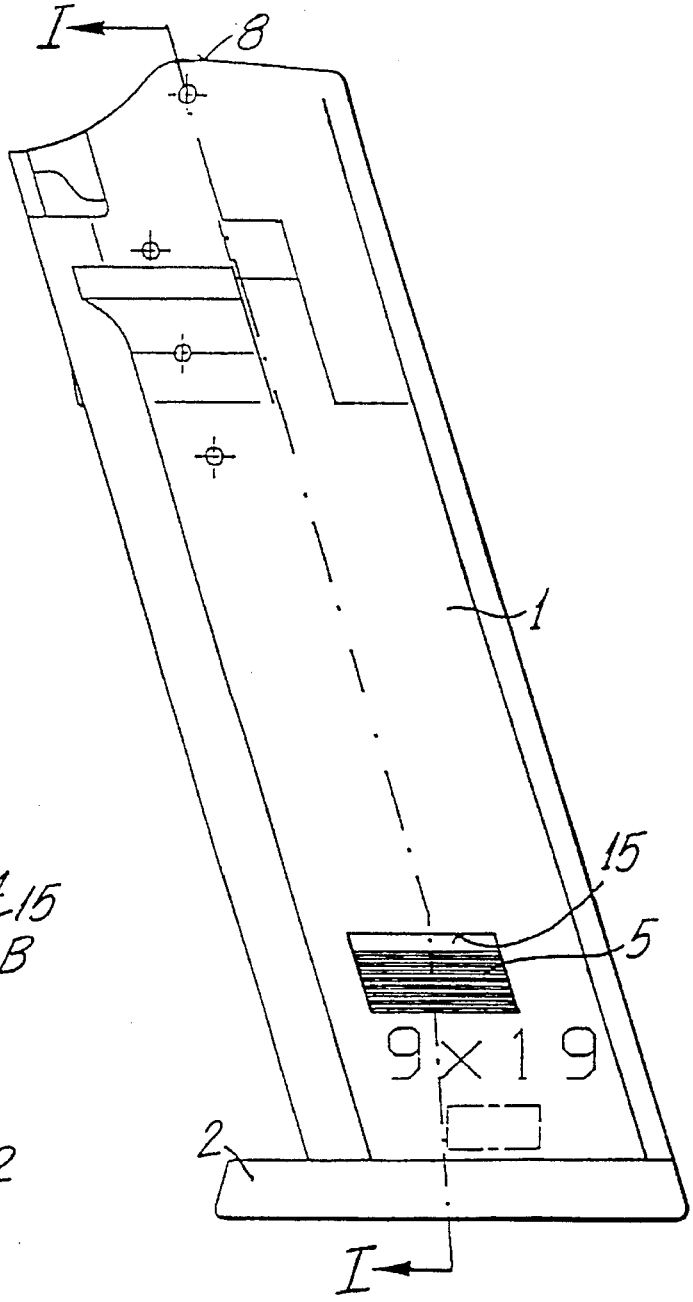
FIG. 2 is a side view of the first embodiment of the magazine illustrated in FIG. 1.
Figure 1A:
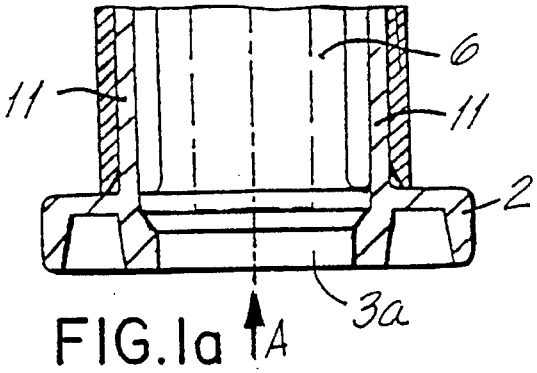
FIG. 1*a* is the same cross section as shown in FIG. 2, but shows an alternative base plate.
Figure 3A:
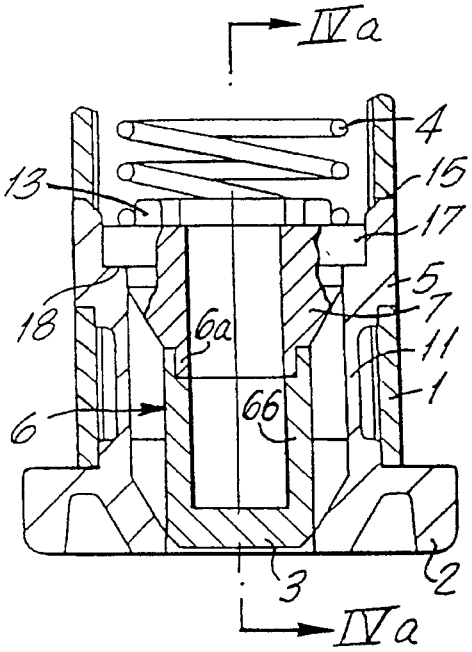
FIG. 3*a* is the same partial cross-section as shown in FIG. 3, but shows a spacer formed from two pieces.

The two embodiments each have a magazine for an automatic pistol. In all the drawings, the same reference numbers are used for identical or equivalent components. In the following description, terms such as "up", "down", "front" and "back" refer to the position of the magazine which is best illustrated in FIG. 2, in which the magazine lips 8 are up, the magazine base 2 is down and, in FIG. 2, the left side (the side toward which the tips of the cartridges 9 point when the magazine is loaded) is the front.

The magazines of the first embodiment (FIGS. 1 and 2) and of the second embodiment (FIGS. 3 and 4) each have a magazine tube 1 which has an approximately rectangular cross section, the upper end of which has magazine lips 8. In the magazine tube, there is a feeder 7 which, on its underside, has a spring seat plate 12, on which is seated the upper side of a graduated or stepped magazine spring 4 which has an approximately rectangular cross section.

Between the upper side of the feeder 7 and the magazine lips 8, there are a number of cartridges 9.

For improved guidance of the cartridges 9, on each of the inside surfaces of the flat sides of the magazine tube 1 there is a strip-shaped guide projection 10, which essentially extends at right angles to the cartridges.

To this extent, the magazine does not differ from similar magazines of the prior art.

Figure 1:
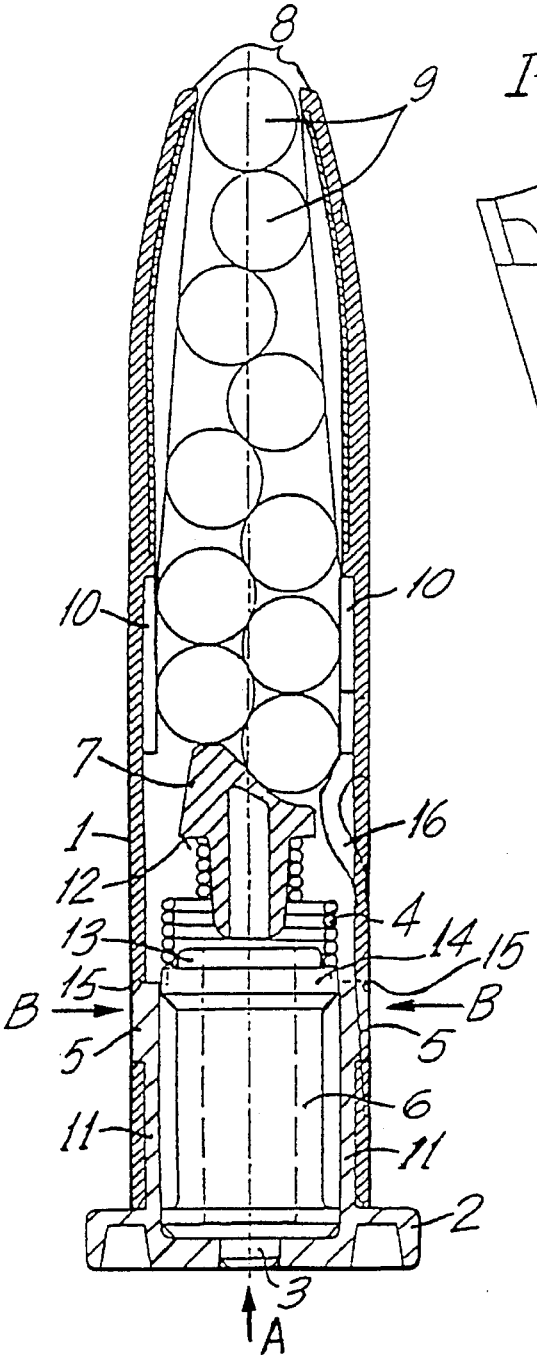
FIG. 1 is a cross section along Line I—I in FIG. 2 through a first embodiment of a magazine as claimed by the invention.

FIG. 1 shows the magazine claimed by the invention filled with cartridges 9 up to its full loading capacity. In the illustrated example, its fully-loaded capacity is ten cartridges.

But the magazine tube has a disproportionately long length which could hold up to 15 cartridges.

The embodiment represents the following teaching of the invention: The external dimensions of the magazine of the prior art (which holds 15 cartridges) are preserved, but its effective capacity (which is irreversible, if possible) is reduced (to only ten shots).

While with a conventional magazine, there is a magazine base 2 on which directly sits a spring seating plate 13 which serves as the bottom support for the magazine spring 4, in the embodiments claimed by the invention, a spacer 6 is inserted between the magazine base 2 and the spring seating plate 13. The height of this spacer 6 corresponds approximately to the space which would be occupied by five cartridges 9 in a zig-zag arrangement in the lower portion of the magazine tube 1.

In the embodiment illustrated in FIGS. 1 and 2, the magazine base 2 has, on both sides, a leg 11 which projects upward, and extends approximately in the middle along the flat sides of the magazine tube 1, and is in contact with it.

The upper ends of the legs 11 have rectangular projections 5 which extend outward and which are seated in rectangular recesses 5, which are designed as holes in the flat sides of the magazine tube 1.

The outside of the projections 5 are ribbed, fit flush against the outside surface of the magazine tube 1, and are large enough that they can be pressed with the thumb and index finger of one hand in the direction indicated by the arrow B, to disengage the magazine base 2 from the magazine tube 1 and remove it.

The spacer 6 is designed as a hollow body closed on the bottom, and on its underside has a central, pin-like projection 3 which is engaged in a matching hole in the magazine base 2. Above the hole, the spacer 6 has an expanded portion with which it is in loosely centered contact against the inside of the legs 11.

On the upper side, the spacer 6 is designed as a spring seating plate 13, on which the magazine spring 4 is seated.

Below this spring seating plate 13, the spacer 6 has an expanded portion 14 which, like the upper expanded portion, is in contact from inside against the legs 11, not on their underside, however, but behind the projections 5. Below this expanded portion there is a bevelled transition to the slimmer body of the spacer 6.

The spacer 6 is pressed by the magazine spring 4 into its rest position, as shown in FIG. 1, and can be pushed out of this rest position by means of a suitable instrument, e.g. a cleaning rod, which is introduced from underneath the magazine base 2 into its hole and pushed in the direction indicated by the arrow A against the pin 3.

In the rest position, the expanded portion 14 is located behind the upper sides of the projections 5 and prevents them from moving in the direction indicated by the arrow B. But if the spacer 6 is raised in the direction indicated by the arrow A, the expanded portion 14 is above the projections 5 and does not prevent them from being pushed in the direction indicated by arrow B until the magazine base 2 is released.

The bevelled lower edge of the expanded portion 14 guarantees that during the assembly of the magazine, the projections 5 are pressed all the way out into the recesses 15.

But if, during the assembly of the magazine, the spacer 6 is left out, and the magazine spring is stretched or replaced by a longer spring, the magazine spring 4 sits directly on the magazine base 2 and exerts a pressure on it which is higher, the more cartridges 9 are loaded into the magazine.

This force is transmitted as a tensile force by the legs 11 to the projections 5, engages them eccentrically, and tips the upper edges of the projections increasingly inwardly (the magazine base is made of plastic, which is flexible, given the low wall thickness of the legs 11), until the projections 5 slip out of the recesses 15. This occurs in particular if the lower boundary surfaces of the recesses 15 and/or the surfaces of the projections 5 which are in contact with these boundary surfaces are bevelled slightly inward. It is then impossible to load the magazine to its full capacity of 15 rounds if the spacer 6 has been removed.

This spacer 6 can also be designed as a one-piece or multi-piece component.

The magazine illustrated in FIG. 1 also has a blocking projection 16, but this feature is optional and can even be omitted if necessary.

This blocking projection is designed as a projection embossed into the one flat side of the magazine tube 1 so that it projects inwardly, catching the lowest of ten cartridges 9 and projecting inside the magazine just far enough so that the feeder 7 can move without interference.

If the spacer 6 is not present and an attempt is made to fasten the magazine base 2 by any measure, so that it cannot be detached in the manner described above, it is still not possible to load an eleventh cartridge and additional cartridges 9 into the magazine, because the tenth bullet 9 sits on the blocking projection 16 and cannot be pushed downward past it. But even if the tenth bullet can be pushed past it by the application of a considerable force, the blocking projection 16 interferes with the correct advance of the cartridges 9 and renders the magazine unusable.

If the blocking projection 16 is missing, an additional feature of the invention comes into play. As shown in FIG. 1, the strip-shaped guide projections 10 do not extend to the bottom of the magazine tube 1, but extend to just below the tenth bullet. But, if the spacer 6 and the blocking projection 16 are both missing (e.g. if the blocking projection 16 has been filed away), and more than ten cartridges 9 are loaded into the magazine, then during the advance of the cartridges, the eleventh cartridge 9 encounters the lower end of the guide projection 10 from below, and the advance of the cartridges is disrupted, which results in a jam.

Figure 4A:
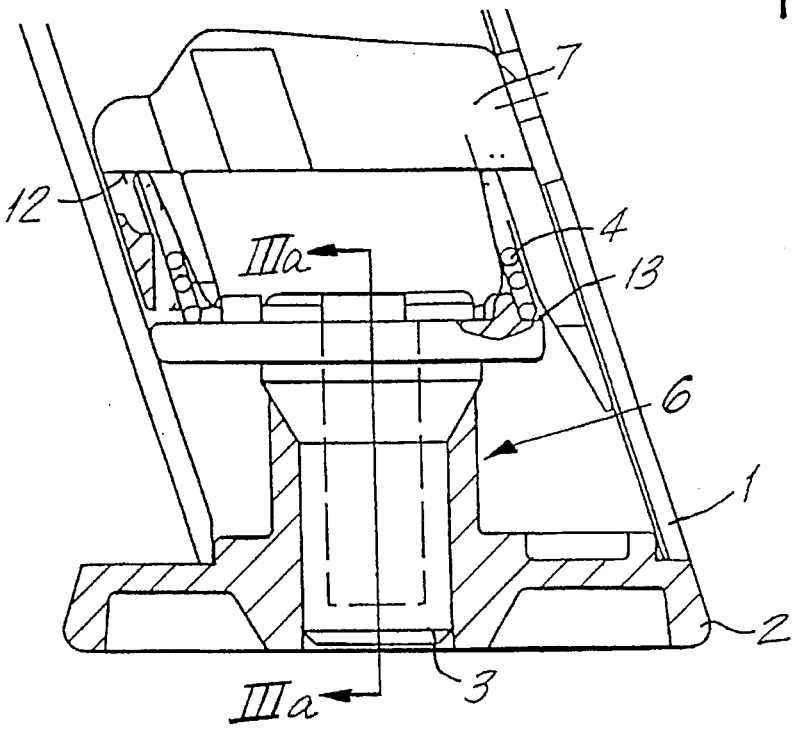
FIG. 4*a* shows the same cross-section as shown in FIG. 4, but shows an integral base-spacer embodiment.
Figure 4:
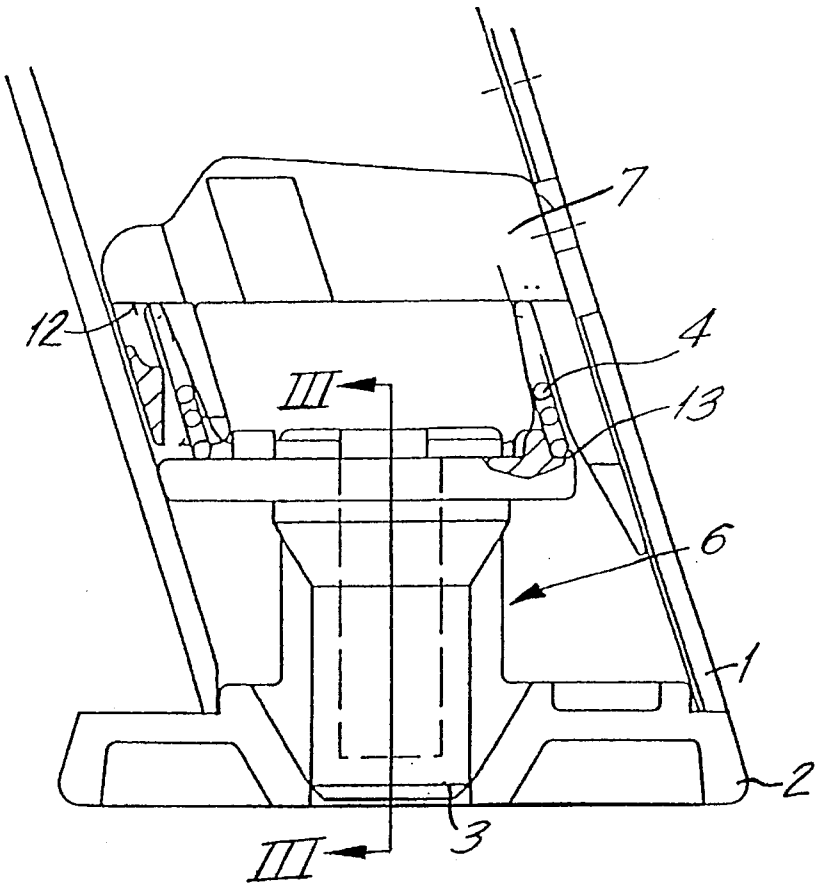
FIG. 4 is a cross section along Line IV—IV in FIG. 3 through the magazine of the second embodiment.
Figure 3:
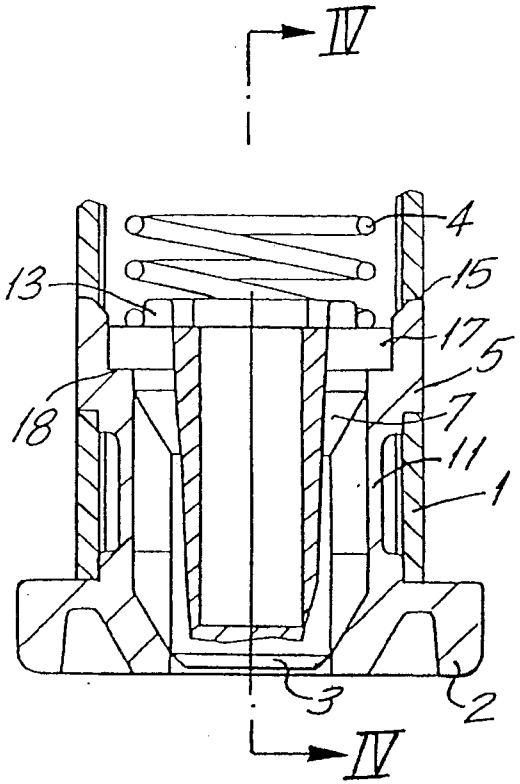
FIG. 3 is a partial cross section along line III—III in FIG. 4 through a second embodiment of a magazine as claimed by the invention.

The second embodiment illustrated in FIGS. 3 and 4 is largely identical to the first embodiment, and is therefore not described in exhaustive detail below. Only the magazine base 2 and the spacer 6 differ from the corresponding elements in the first embodiment and will therefore be described in detail.

First, the pin-like extension 3 has a larger diameter than the one shown in FIG. 1. A relatively blunt object, e.g. a bullet, can therefore be used as a tool to push up the extension 3.

The vicinity of the hole in the magazine base 2 is conically tapered on the inside, to guide and center the pin-like extension 3 during assembly. The lower expanded portion of the spacer in the first embodiment, which performed this guidance and centering function, is therefore unnecessary.

Moreover, on each inside of each of the projections 5, there is a seat 18 which extends at approximately right angles to the projection 5 toward the magazine tube 1, whereby all the seats 18 are at the same height.

On the spacer 6, where the expanded portion 14 is located in the first embodiment, there is a shoulder 17 which matches the seat 18 and sits on it when the spacer 6 is in its rest position.

Thus the force of the magazine spring 4 is transmitted from the spring seating plate 13 on the spacer 6 via its shoulder 17 directly to the projections 5 and thus via the recesses 15 to the magazine tube 1. Except for the projections 5, no forces are exerted on the magazine base 2.

The legs 11, which during normal use are not called upon to transmit any forces, each have a predetermined breaking point, which is indicated in FIG. 3 as a groove or channel in the respective legs 11.

The predetermined breaking point is defined so that it will reliably break if, in the absence of the spacer 6, a force is exerted by the magazine spring 4 on the magazine base 2, which corresponds to a magazine load of more than ten cartridges 9.

In the embodiment illustrated in FIGS. 3 and 4, the pin-like extension 3 and, correspondingly, its locator opening in the magazine base 2, can be enlarged so that the magazine spring 4 fits through this opening, and when the spacer 6 is missing, the spring 4 can no longer be supported on the magazine base 2.

The second embodiment can optionally have the characteristics of the first embodiment which contribute to its effect, such as the blocking projection 16 and/or the shortened, strip-shaped guide projections 10.

What is claimed:

1. A magazine for an automatic pistol, comprising:

a spacer for reducing the usable capacity of the magazine while preserving substantially the external dimensions of the magazine, a magazine tube, including a magazine spring, a feeder, and a magazine base, wherein the spacer is disposed inside the magazine tube between the magazine base and the magazine spring, and wherein the magazine spring, in the absence of the spacer, does not exert a force on the feeder to advance the last cartridge to the end of the magazine tube, and wherein the spacer is designed to interact with the magazine base so that in the absence of the spacer, and when the magazine is loaded with more cartridges than permitted, the magazine base is at least partly detached from its mounting on the other end of the magazine tube.

2. The magazine as claimed in claim 1, wherein the magazine tube is designed with two flat sides opposite one another, and has magazine lips on its one end, the feeder is located inside the magazine tube so that it can move in the longitudinal direction of the magazine tube, and on its side farther from the magazine lips has a spring seating plate, the magazine base provides a closure on the other end of the magazine tube, and is detachably attached to the tube by a locking mechanism, and which further comprises a spring seating plate located on the side of the magazine base facing the magazine lips and having a spring seating surface which faces the magazine lips, and wherein the magazine spring being inserted between the spring seating plate on the feeder and the spring seating surface, wherein the spacer, located between the magazine base and the spring seating surface, is movable between a rest position into a disengaged position, wherein in the rest position the locking device is locked and reliably holds the magazine base on the magazine tube, and the disengaged position, the locking device is released, so that in the absence of the spacer, when the force of the magazine spring acts on the magazine base, the base is no longer reliably attached to the magazine tube and a predetermined breaking point on the magazine base destroys the magazine base, rendering the magazine unusable.

3. The magazine as claimed in claim 2, wherein the spacer and the spring seating plate are provided as a one-piece component.

4. The magazine as claimed in claim 2, wherein the spacer is comprised of several parts.

5. The magazine as claimed in claim 2, wherein the magazine base and the spacer are being attached to one another so that they cannot be separated without being destroyed, but that the spacer can execute a limited movement with respect to the magazine base.

6. The magazine as claimed in claim 2, wherein the magazine base has an opening through which the spacer is being pushed, against the force of the magazine spring toward the feeder into its disengaged position.

7. The magazine as claimed in claim 6, wherein there is a pin-like extension on the spacer which projects toward the base, and which, in the rest position, is engaged in the opening.

8. The magazine as claimed in claim 2, including at least one flexible leg arranged on the magazine base extending toward the feeder and along the inside of opposite walls of the magazine tube, and on each of their free ends have a projection which extends into a corresponding recess in the corresponding wall of the magazine tube, forming a locking mechanism, and wherein the projections and the corresponding recesses are designed so that when the full force of the magazine spring is exerted, the projections flex toward the inside of the magazine tube, and are thereby disengaged from the recesses, and the spacer having a locking segment which, in the rest position of the spacer, supports each of the projections away from the inside of the magazine tube, but releases them when the spacer is in the disengaged position.

9. The magazine as claimed in claim 8, wherein the magazine base, the legs and the projections are made of flexible plastic.

10. The magazine as claimed in claims 8, wherein the outside surfaces of the projections in their locking position do not extend beyond the outside surface of the magazine tube and are preferably flush with the latter.

11. The magazine as claimed in claim 8, wherein the outside surfaces of the projections are being pushed in with a finger when the magazine is being disassembled.

12. The magazine as claimed in claim 7, wherein a seat is provided on the facing sides of the projections, on which the spacer having a shoulder and at least one of the legs is located which forms a predetermined breaking point which breaks not later than when, in the absence of the spacer and when the magazine is loaded to more than its reduced capacity, the force of the magazine spring is exerted directly on the magazine base.

13. The magazine as claimed in claim 6, wherein a seat is provided on the facing sides of the projections, on which the spacer is located, having a shoulder matching the spacer and to which the shoulder is capable of transmitting force, and wherein the opening in the magazine base is sized so that it does not form a contact point for the magazine spring, so that when the spacer is removed, the magazine spring pushes into or through the opening, and that the underside of the spacer is designed to match the opening, and closes it when the spacer is in the rest position.

14. The magazine as claimed in claim 2, wherein at the inside of at least one of the flat sides of the magazine tube there is at least one guide projection which extends from the corresponding magazine lip to the position of the lowest cartridge when the magazine is full.

15. The magazine as claimed in claims 2, wherein on the inside of at least one of the flat sides of the magazine tube, close below the point at which, when the magazine is filled, the lowest cartridge is in contact with this inside, there is a blocking projection which prevents a further movement of the lowest cartridge toward the magazine base, even if the spacer is missing.

* * * * *